US006021608A

United States Patent [19]

Ollison

[11] Patent Number: 6,021,608

[45] Date of Patent: Feb. 8, 2000

[54] INTERIOR WINDOW LOCKING SYSTEM

[76] Inventor: Charles A. Ollison, R.R. 2 Box 685, Gurdon, Ark. 71743

[21] Appl. No.: 09/262,241

[22] Filed: Mar. 4, 1999

[51] Int. Cl.[7] ..... E05F 1/00

[52] U.S. Cl. ..... 49/449; 49/370; 292/67

[58] Field of Search ..... 49/366, 370, 449; 70/DIG. 65; 292/DIG. 1, DIG. 46, 67, 68, 114, 128

[56] References Cited

U.S. PATENT DOCUMENTS 997,120 7/1911 Ehlert ..... 49/370
3,583,738 6/1971 Uphoff ..... 292/67
5,028,082 7/1991 Kronbetter ..... 49/370 X
5,064,230 11/1991 Ornouff ..... 49/449 X
5,893,242 4/1999 Perron ..... 49/360 X

*Primary Examiner*—Jerry Redman

[57] ABSTRACT

A new interior window locking system for preventing intruders from gaining illegal entry into a building. The inventive device includes a pair of horizontally disposed guide rails secured above and below a window within a window frame. A pair of square tubing frames are slidably disposed between the guide rails. Each of the frames have a steel grate disposed therein. A spring-loaded latch assembly is disposed on corresponding inner members of the pair of square tubing frames for engagement thereof.

5 Claims, 4 Drawing Sheets

FIG. 2
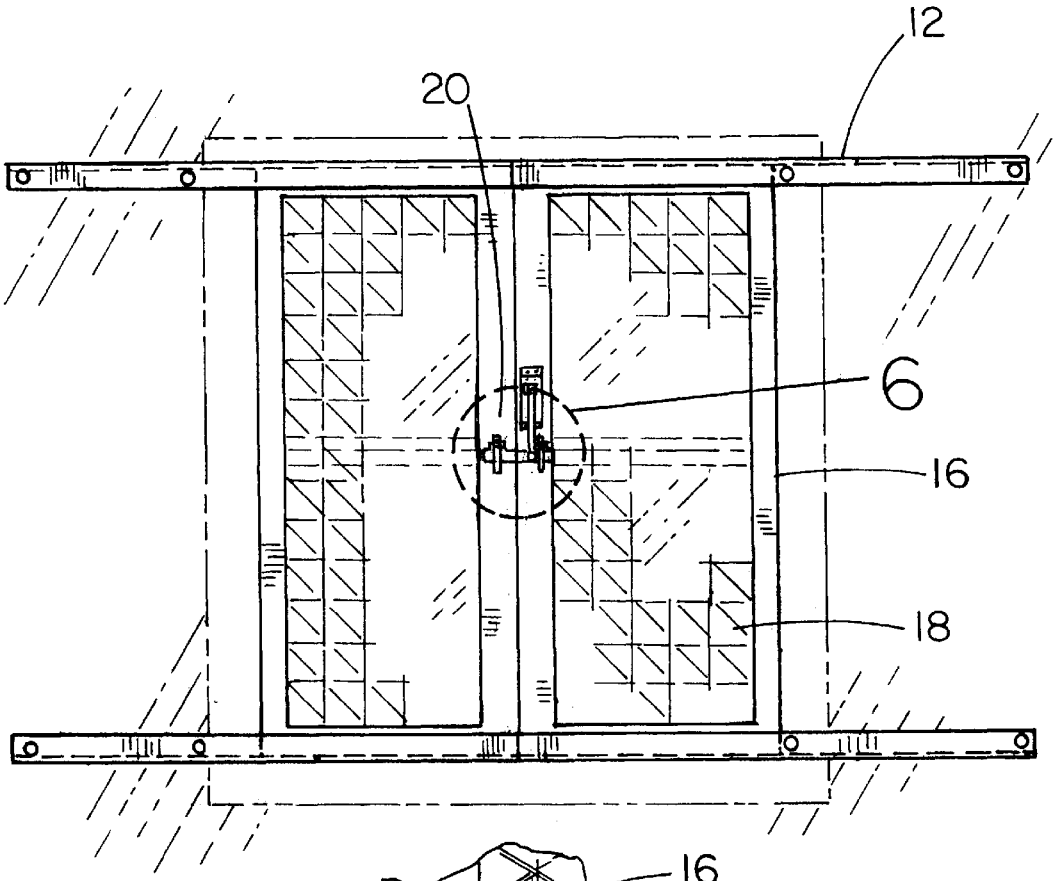
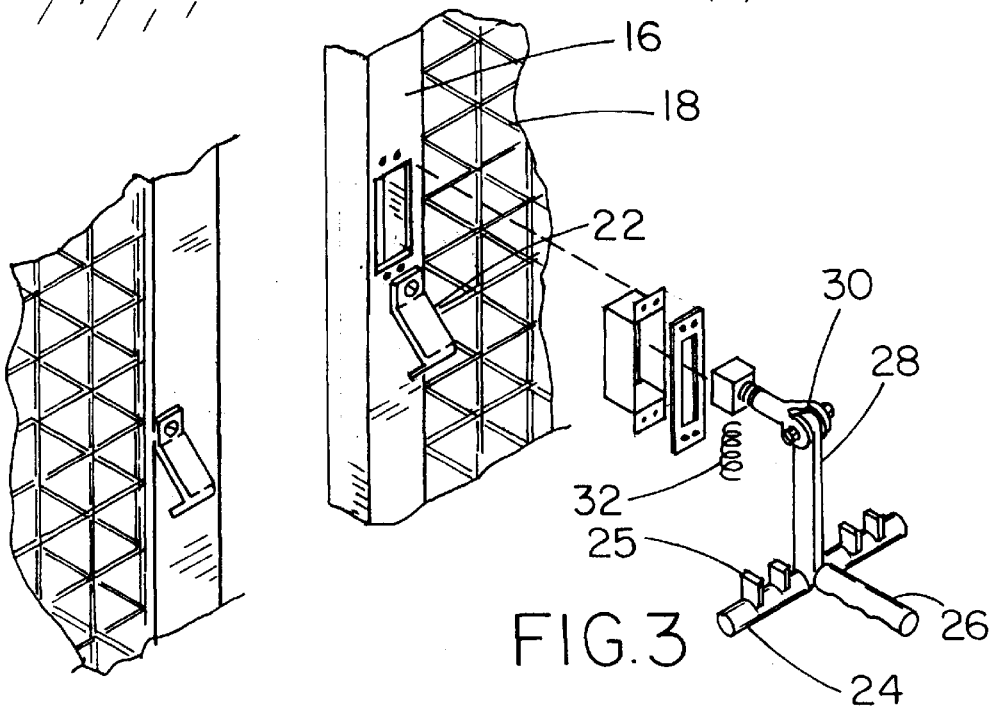
FIG. 3

INTERIOR WINDOW LOCKING SYSTEM

BACKGROUND OF THE INVENTION

1. Field of the Invention

The present invention relates to anti-burglar devices and more particularly pertains to a new interior window locking system for preventing intruders from gaining illegal entry into a building.

2. Description of the Prior Art

The use of anti-burglar devices is known in the prior art. More specifically, anti-burglar devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art anti-burglar devices include U.S. Pat. No. 4,243,090 to Kemp; U.S. Pat. No. 4,127,156 to Brandt; U.S. Pat. No. 5,386,664 to Lumenello; U.S. Pat. No. 4,000,590 to Kordewick; U.S. Pat. No. Des. 269,380 to d'Avila; and U.S. Pat. No. 4,127,966 to Schmidt.

While these devices fulfill their respective, particular objectives and requirements, the aforementioned patents do not disclose a new interior window locking system. The inventive device includes a pair of horizontally disposed guide rails secured above and below a window within a window frame. A pair of square tubing frames are slidably disposed between the guide rails. Each of the frames have a steel grate disposed therein. A spring-loaded latch assembly is disposed on corresponding inner members of the pair of square tubing frames for engagement thereof.

In these respects, the interior window locking system according to the present invention substantially departs from the conventional concepts and designs of the prior art, and in so doing provides an apparatus primarily developed for the purpose of preventing intruders from gaining illegal entry into a building.

SUMMARY OF THE INVENTION

In view of the foregoing disadvantages inherent in the known types of anti-burglar devices now present in the prior art, the present invention provides a new interior window locking system construction wherein the same can be utilized for preventing intruders from gaining illegal entry into a building.

The general purpose of the present invention, which will be described subsequently in greater detail, is to provide a new interior window locking system apparatus and method which has many of the advantages of the anti-burglar devices mentioned heretofore and many novel features that result in a new interior window locking system which is not anticipated, rendered obvious, suggested, or even implied by any of the prior art anti-burglar devices, either alone or in any combination thereof.

To attain this, the present invention generally comprises a pair of horizontally disposed guide rails secured above and below a window within a window frame. Opposite ends of the rails each have a stop mechanism disposed thereon. A pair of square tubing frames are slidably disposed between the guide rails. Each of the frames have a generally rectangular configuration. Each of the frames have a steel grate disposed therein. A spring-loaded latch assembly is disposed on corresponding inner members of the pair of square tubing frames. The latch assembly includes a pair of handles secured to the inner members. The latch assembly includes a locking mechanism. The locking mechanism includes a horizontal bolt extendable between the pair of handles. The horizontal bolt includes an outwardly extending segment disposed centrally thereof. The outwardly extending segment abuts each of the handles. The horizontal bolt has a vertical bolt extending upwardly therefrom. An upper free end of the vertical bolt is pivotally coupled with the inner member of one of the square tubing frames. An inner end of the upper free end is coupled with a spring. The spring biases the vertical bolt against the inner member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interior window locking system apparatus and method which has many of the advantages of the anti-burglar devices mentioned heretofore and many novel features that result in a new interior window locking system which is not anticipated, rendered obvious, suggested, or even implied by any of the prior art anti-burglar devices, either alone or in any combination thereof.

It is another object of the present invention to provide a new interior window locking system which may be easily and efficiently manufactured and marketed.

It is a further object of the present invention to provide a new interior window locking system which is of a durable and reliable construction.

An even further object of the present invention is to provide a new interior window locking system which is susceptible of a low cost of manufacture with regard to both materials and labor, and which accordingly is then susceptible of low prices of sale to the consuming public, thereby making such interior window locking system economically available to the buying public.

Still yet another object of the present invention is to provide a new interior window locking system which provides in the apparatuses and methods of the prior art some of the advantages thereof, while simultaneously overcoming some of the disadvantages normally associated therewith.

Still another object of the present invention is to provide a new interior window locking system for preventing intruders from gaining illegal entry into a building.

Yet another object of the present invention is to provide a new interior window locking system which includes a pair of horizontally disposed guide rails secured above and below a window within a window frame. A pair of square tubing frames are slidably disposed between the guide rails. Each of the frames have a steel grate disposed therein. A spring-loaded latch assembly is disposed on corresponding inner members of the pair of square tubing frames for engagement thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a front view of the present invention illustrated in a closed orientation.

FIG. 3 is a perspective view of the spring-loaded latch assembly of the present invention as taken from circle 3 of FIG. 2.

DESCRIPTION OF THE PREFERRED EMBODIMENT

Figure 1:
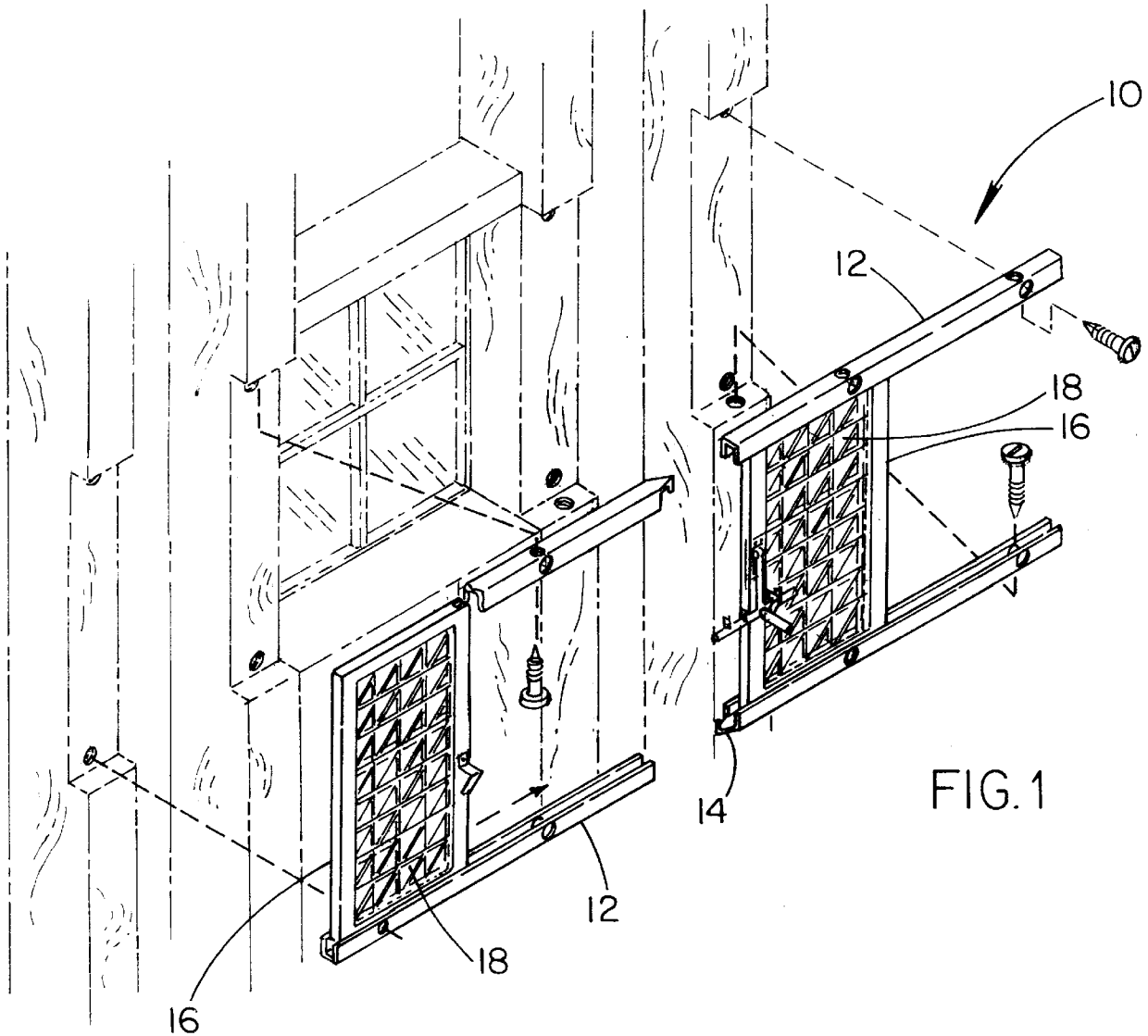
FIG. 1 is a perspective view of a new interior window locking system according to the present invention.
Figure 4:
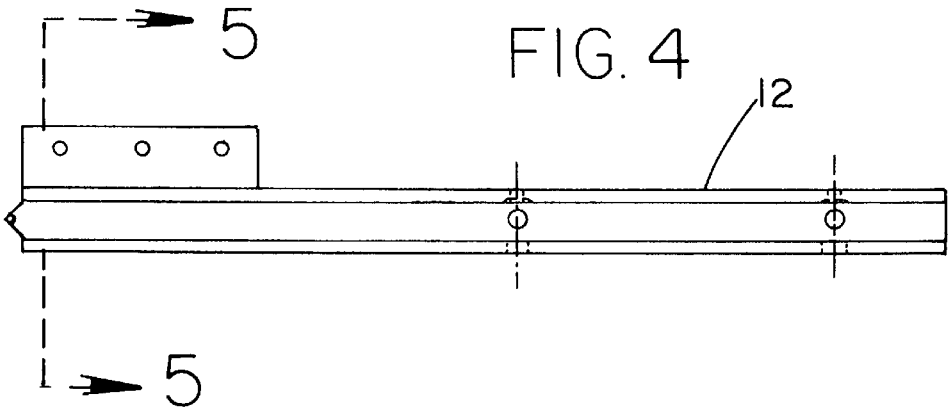
FIG. 4 is a side view of a guide rail of the present invention.
Figure 5:
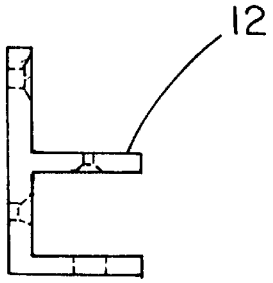
FIG. 5 is a cross-sectional view of a guide rail of the present invention taken from line 5—5 of FIG. 4.
Figure 6:
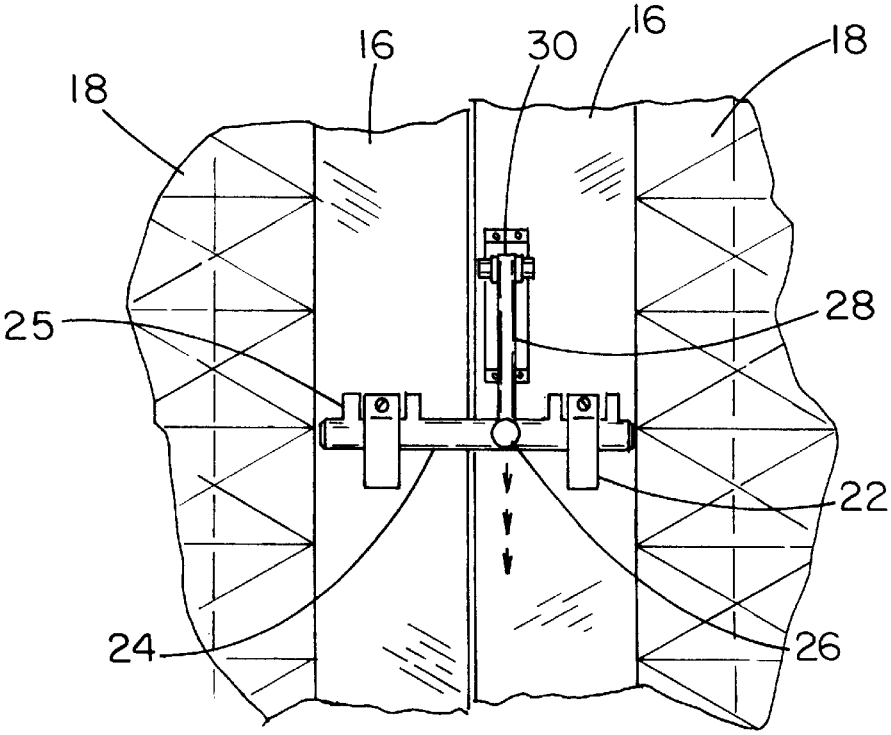
FIG. 6 is a side view of the present invention particularly illustrating a spring loaded latch assembly.

With reference now to the drawings, and in particular to FIGS. 1 through 9 thereof, a new interior window locking system embodying the principles and concepts of the present invention and generally designated by the reference numeral 10 will be described.

As best illustrated in FIGS. 1 through 9, the interior window locking system 10 comprises a pair of horizontally disposed guide rails 12 secured above and below a window within a window frame. Opposite ends of the rails 12 each have a stop mechanism 14 disposed thereon. Preferably, ends of the guide rails would feature holes that would permit them to be fastened to the wood framing of a structure with lag bolts or related fasteners.

A pair of square tubing frames 16 are slidably disposed between the guide rails 12. Each of the frames 16 have a generally rectangular configuration. Each of the frames 16 have a steel grate 18 disposed therein. The stop mechanisms 14 would prevent the inadvertent disengagement of the frames 16 from the guide rails 12. Preferably, the guide rails 12 would measure twice the length of the square tubing frames 16.

A spring-loaded latch assembly 20 is disposed on corresponding inner members of the pair of square tubing frames 16. The latch assembly 20 includes a pair of handles 22 secured to the inner members. The latch assembly 20 includes a locking mechanism. The locking mechanism includes a horizontal bolt 24 extendable between the pair of handles 22. The horizontal bolt 24 includes an outwardly extending segment 26 disposed centrally thereof. The horizontal bolt 24 has a plurality of flanges 25 that abut the handles 22. The horizontal bolt 24 has a vertical bolt 28 extending upwardly therefrom. An upper free end 30 of the vertical bolt 28 is pivotally coupled with the inner member of one of the square tubing frames 16. An inner end of the upper free end 30 is coupled with a spring 32. The spring 32 biases the vertical bolt 28 against the inner member.

In use, the present invention is mounted on the inside of the window, rather than on its exterior. The frame members 16 are slid together as shown in FIG. 2. The outwardly extending member 26 of the spring-loaded latching assembly 20 is pulled down and the horizontal bolt 24 is placed under the pair of handles 22 and released. The biasing of the spring-loaded latching assembly 20 holds the horizontal bolt 24 in an engaged position against the pair of handles 22. Flanges 25 on the horizontal bolt 24 abut the handles 22 to prevent the frame members 16 from being slid open.

Figure 7:
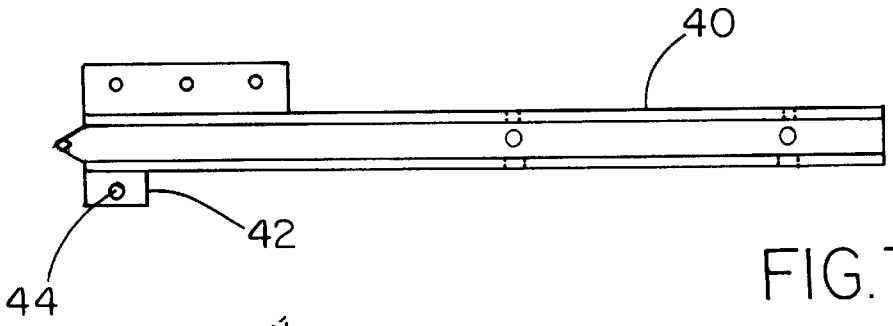
FIG. 7 is a side view of a guide rail of an alternate embodiment of the present invention.
Figure 8:
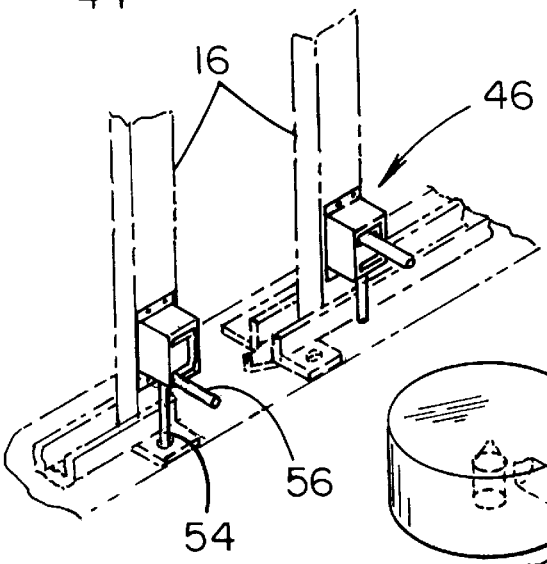
FIG. 8 is a perspective view of an alternate embodiment of the present invention
Figure 9:
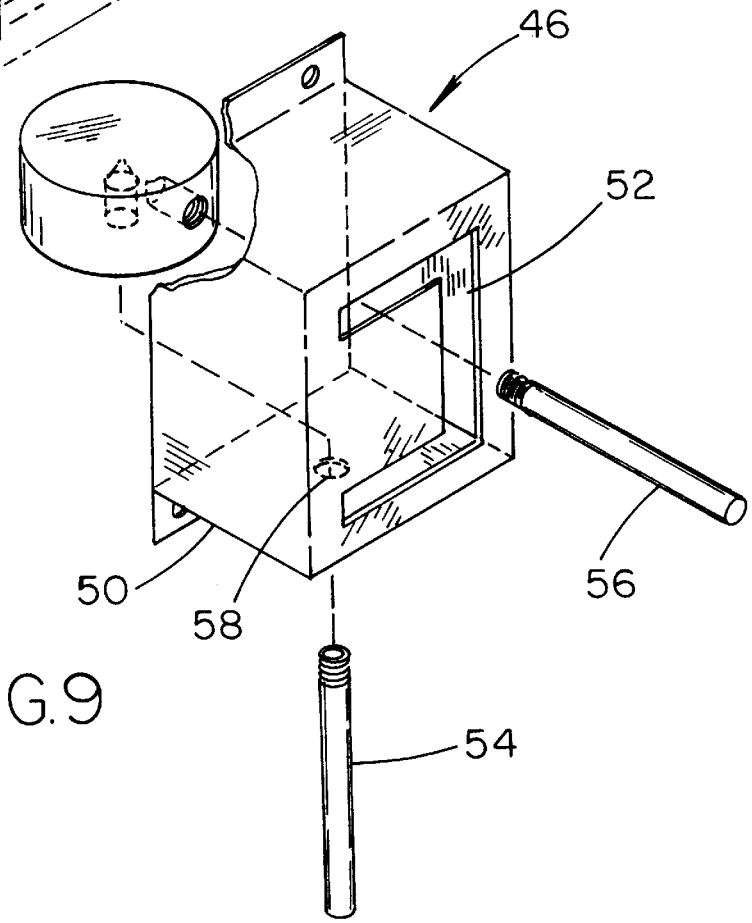
FIG. 9 is a perspective view of a spring-loaded latch assembly of an alternate embodiment of the present invention

In an alternate embodiment of the present invention, as particularly illustrated in FIGS. 7 through 9, alternate guide rails 40 have a flange 42 with a hole 44 that extends through the flange 42. A pair of alternate latch assemblies 46 are disposed on corresponding inner members of the pair of square tubing frames 16. The alternate latch assembly 46 comprises a housing 50 having a C-shaped slot 52 extending through a face of the housing 50. Horizontal lifting member 56 extends through the C-shaped slot 52 and into the interior of the housing 50. A vertical locking member 54 extends through an aperture 58 in the bottom of the housing 50. The vertical locking member 54 is coupled to the horizontal lifting member 56 such that moving the horizontal lifting member 56 between the upper and lower portions of the C-shaped slot 52 raises and lowers the vertical locking member 54 between a locked position and an unlocked position. An end of the vertical locking member 54 is insertable in a hole 44 of the flange 42 of an alternate guide rail 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new interior window locking system for preventing intruders from gaining illegal entry into a building comprising, in combination:

a pair of horizontally disposed guide rails secured above and below a window within a window frame, opposite ends of the rails each having a stop mechanism disposed thereon;

a pair of square tubing frames slidably disposed between the guide rails, each of the frames having a generally rectangular configuration, each of the frames having a steel grate disposed therein; and a spring-loaded latch assembly disposed on corresponding inner members of the pair of square tubing frames, the latch assembly including a pair of handles secured to the inner members, the latch assembly including a locking mechanism, the locking mechanism including a horizontal bolt extendable between the pair of handles, the horizontal bolt including an outwardly extending segment disposed centrally thereof the horizontal bolt having a plurality of flanges abutting the handles, the horizontal bolt having a vertical bolt extending upwardly therefrom, an upper free end of the vertical bolt being pivotally coupled with the inner member of one of the square tubing frames, an inner end of the upper free end being coupled with a spring, the spring biasing the vertical bolt against the inner member.

2. A interior window locking system for preventing intruders from gaining illegal entry into a building comprising:

a pair of horizontally disposed guide rails for securing above and below a window mounted in a window frame, an upper one of the guide rails being securable to a window frame above a window and a lower one of the guide rails being securable to the window frame below the window, each of the guide rails being generally U-shaped and defining a groove therein being positionable in an opposed orientation;

a pair of frames slidably disposed between the guide rails, the frames each having upper and lower edges, the upper edge of each frame being slidably received in the groove of the upper guide rail and the lower edge of each frame being slidably received in the groove of the lower guide rail such that the guide rails resist pulling of the frames away from a window about which the guide rails are mounted, each of the frames having a grate disposed therein; and a spring-loaded latch-assembly disposed on corresponding inner members of the pair of frames for engagement thereof, wherein the latch assembly includes a pair of handles secured to the inner members, the latch assembly including a locking mechanism having a horizontal bolt extendable between the pair of handles, the horizontal bolt including an outwardly extending segment disposed centrally thereof, the horizontal bolt having a vertical bolt extending upwardly therefrom, an upper free end of the vertical bolt being pivotally coupled with the inner member of one of the frames, a spring biasing the vertical bolt against the inner member.

3. The interior window locking system as set forth in claim 2 wherein opposite ends of the rails each have a stop mechanism disposed thereon.

4. An interior window locking system for preventing intruders from gaining illegal entry into a building comprising, in combination:

a pair of horizontally disposed guide rails secured above and below a window within a window frame;

a pair of frames slidably disposed between the guide rails, each of the frames having a steel grate disposed therein; and a spring-loaded latch assembly disposed on corresponding inner members of the pair of frames for engagement thereof;

wherein the latch assembly includes a pair of handles secured to the inner members, the latch assembly including a locking mechanism, the locking mechanism including a horizontal bolt extendable between the pair of handles, the horizontal bolt including an outwardly extending segment disposed centrally thereof, the horizontal bolt having a plurality of flanges abutting the handles, the horizontal bolt having a vertical bolt extending upwardly therefrom, an upper free end of the vertical bolt being pivotally coupled with the inner member of one of the frames, an inner end of the upper free end being coupled with a spring, the spring biasing the vertical bolt against the inner member.

5. The interior window locking system as set forth in claim 4 wherein opposite ends of the rails each have a stop mechanism disposed thereon.

* * * * *